US005590549A

United States Patent [19]

Alberto

[11] Patent Number: 5,590,549

[45] Date of Patent: Jan. 7, 1997

[54] DEVICE FOR FEEDING INTO AND WITHDRAWING FABRICS FROM AN AUTOCLAVE FOR CONTINUOUS DECATIZING

[76] Inventor: Pietro Alberto, Strada Masserano Calaria, 70, Biella, (Vercelli), Italy

[21] Appl. No.: 416,766

[22] PCT Filed: Nov. 2, 1992

[86] PCT No.: PCT/IT92/00114

§ 371 Date: Apr. 13, 1995

§ 102(e) Date: Apr. 13, 1995

[87] PCT Pub. No.: WO94/10367

PCT Pub. Date: May 11, 1994

[51] Int. Cl.[6] ..... D06B 23/18

[52] U.S. Cl. ..... 68/5 E; 34/242

[58] Field of Search ..... 68/5 E, 5 C; 34/242

[56] References Cited

U.S. PATENT DOCUMENTS

| | | | |
|---|---|---|---|
| 2,260,128 | 10/1941 | Walter | 34/242 |
| 2,459,295 | 1/1949 | Skoog | 34/242 X |
| 3,066,518 | 12/1962 | Fujihashi | 34/242 X |
| 3,291,468 | 12/1966 | Albertsen et al. | 34/242 |
| 3,302,423 | 2/1967 | Morrison | 34/242 X |
| 3,943,640 | 3/1976 | Fritsch et al. | 34/242 |
| 4,002,346 | 1/1977 | Lopata et al. . | |
| 4,184,346 | 1/1980 | Sando et al. | 68/5 E |
| 4,186,571 | 2/1980 | Gorodissky et al. | 68/5 E |
| 4,301,665 | 11/1981 | Lopata | 68/5 E |

FOREIGN PATENT DOCUMENTS

| | | | |
|---|---|---|---|
| 2314125 | 1/1977 | France . | |
| 1206866 | 12/1965 | Germany . | |
| 2810660 | 9/1979 | Germany . | |
| 955826 | 4/1964 | United Kingdom | 34/242 |

*Primary Examiner*—Frankie L. Stinson

*Attorney, Agent, or Firm*—Panitch Schwarze Jacobs & Nadel, P.C.

[57] ABSTRACT

A device for feeding into and respectively withdrawing from an autoclave (1), of fabric (11) to be continuously decatized under pressure, together with a felt back cloth (3), includes in addition to the already known lead-in center cylinder (5) between the two runs of fabric going in and coming out (3, 11; 3', 11'), a pair of side cylinders (4, 6) cooperating with the above (5) and replacing the already known inflatable gaskets. It is the fabric-felt assembly (3, 11) itself that, by being compressed between the two pairs of cylinders (4, 5; 5, 6) builds a barrier against steam leakages. The center cylinder (5) and/or the two side cylinders (4, 6) may be recessed in order to define, in the nip area, a recess shallower that the thickness of the paired materials. In case all three cylinders (4, 5, 6) are smooth, the distance thereof will be suitably controlled for said purpose, and in both nip areas antifriction material pads (13, 13'), such as teflon, are preferably provided, in order to seal, at both ends of the cylinders, the gaps existing between the end of the felt and the side support members (15) of said cylinders.

10 Claims, 2 Drawing Sheets

Figure 1:
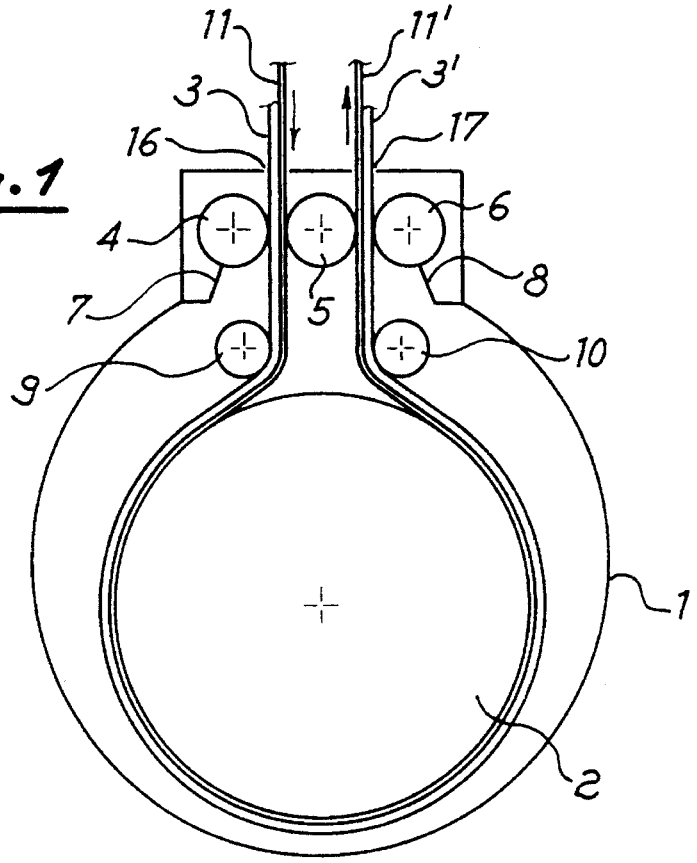

DEVICE FOR FEEDING INTO AND WITHDRAWING FABRICS FROM AN AUTOCLAVE FOR CONTINUOUS DECATIZING

This invention concerns an improved device for feeding into and withdrawing a fabric from a pressurized autoclave for continuous decatizing, wherein friction is reduced to a minimum and simultaneously an optimum sealing against steam leakages is provided.

A device is already known for a leakproof introduction of a fabric into an autoclave for continuous decatizing, as described and claimed in Patent Application MI91001119 filed on Apr. 23, 1991 by the present Applicant and Inventor, which device substantially includes a rotating cylinder adapted to seal the slit provided for the fabric and the related back cloth to enter the autoclave or exit therefrom, as well as two juxtaposed resilient members acting as sealing gaskets. However, it is apparent that friction developing between the rotating center member and the pair of stationary side gaskets, preferably comprising inflatable air bags, may be too high because of the wear it may cause. To waive this problem, sheets of antifriction material are inserted between the cylinder and the side gaskets, possibly wrapped around special rollers in order to be able to move forward, continuously or intermittently, for the purpose of changing the contact area with said gaskets.

However said approach might not be considered completely satisfactory mainly when particularly abrasive felts are used as back cloths, while it is apparent that there is no way to reduce below a certain threshold the friction which develops between a rotating and a stationary surface.

Therefore, it is an object of this invention to reduce said friction as much as possible by replacing the stationary gaskets with rotating side cylinders, whereby only revolving friction develops which is certainly lower than the sliding friction likely to arise at the stationary surface of the rubber gaskets. In any case, sealing is provided by said felt associated with the fabric, whose large thickness allows it to be compressed in the nip between the cylinders, whereby it actually operators as a real gasket.

According to a preferred embodiment, the engagement area between center cylinder and the pair of side cylinders defines a nip which is not so deep as the thickness of the two associated materials (the felt and the fabric) in that the side surface of the center cylinder and/or of the pair of side cylinders is recessed for a width not narrower than the felt width.

In a further embodiment, the three cylinders have smooth surfaces whose mutual distances are smaller than the thickness of the two associated materials, antifriction material pads beind provided in this case at the two nips, on either side of the cylinders, in order to assure side sealing against steam leakages.

Figure 3:
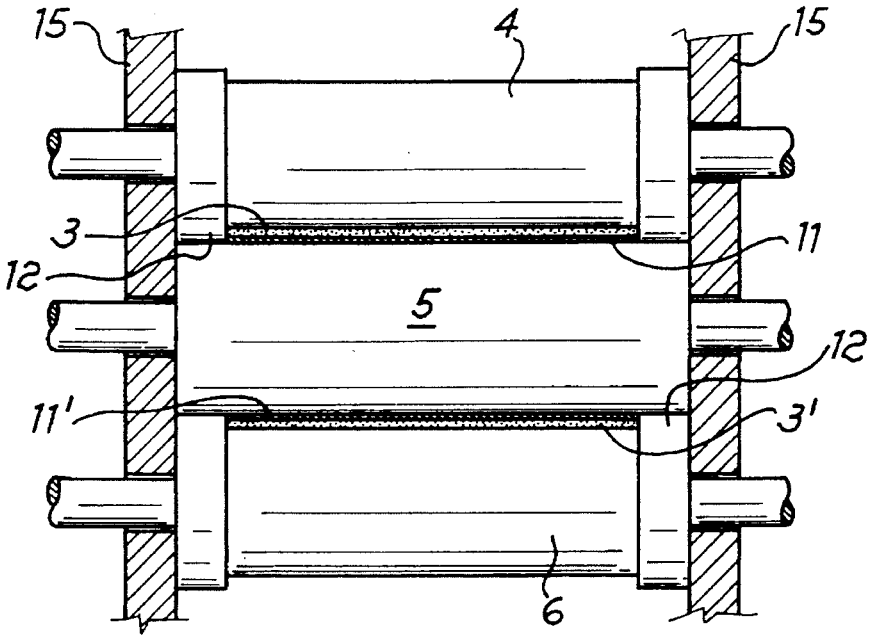
Figure 2:
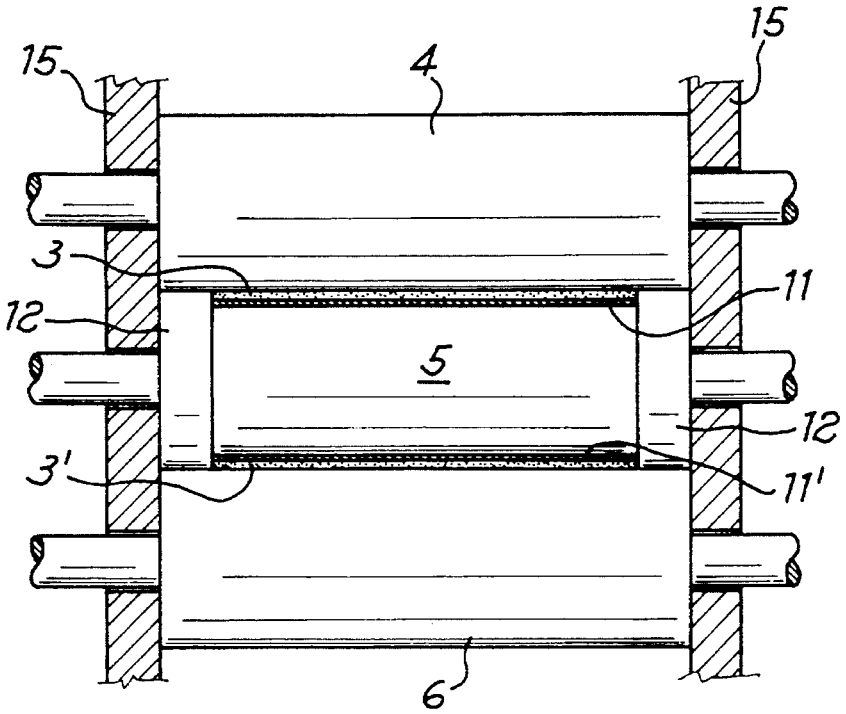
Figure 4:
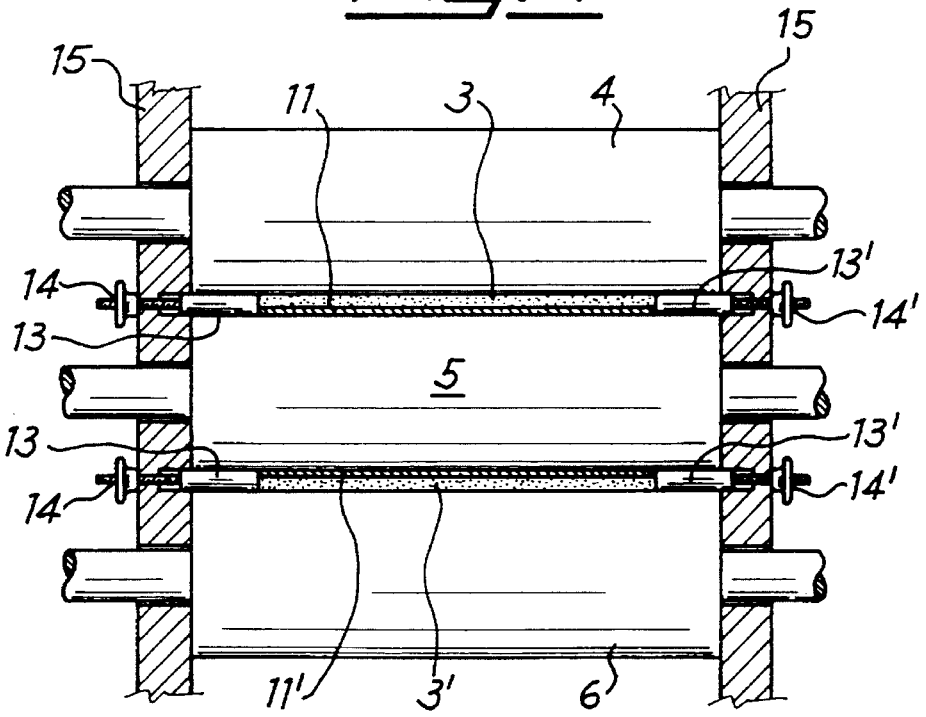

The above and other objects, advantages and features of this invention will become more apparent from the following detailed description of some embodiments described herein for exemplary and non limiting purposes, reference being made to the attached drawings, wherein:

FIG. 1 is a cross-sectional schematic of a continuous decatizing autoclave provided with the device according to this invention; and FIGS. 2, 3 and 4 are schematic and partial top plan views of FIG. 1, showing the fabric introduction and withdrawing area, for three different embodiments of the introducing and withdrawing cylinders.

Referring now to the drawing, as in the above mentioned previous patent application, a continuos decatizing autoclave 1 includes a rotating foraminous cylinder 2, preferably lined with a felt (not shown in the drawing), bearing fabric 11 wrapped therearound together with a back cloth 3 which is preferably a substantially thick felt. Fabric 11 is thus subjected to the action of steam under pressure produced inside the autoclave and to a squeezing condition caused by being sandwiched between the back cloths, and in such a way a particular finish is obtained which is typical of this decatizing process. According to this invention, felt 3 and fabric 21 are brought into the autoclave by going through the nip between a pair of rotating cylinders 4 and 5, and they come out from the autoclave with respective reference numbers 3', 11' by going through the nip between cylinders 5 and 6. The route around foraminous cylinder 2 begins and ends substantially at the pair of guide rollers 9 and 20 respectively.

In order to avoid heavy steam leakages to the environment and the related pressure drops within the autoclave, it is necessary to provide the best sealing at the nips between the cylinders where the associated materials are fed into and withdrawn from the machine. For this purpose, in order to prevent peripheral steam leakages around side cylinders 4 and 6, resilient sheet gaskets 7 and 8 are provided, having their free end resting on the surface of cylinders 4 and 6 respectively in order to avoid that above cylinders 4, 5 and 6 there is a steam pressure comparable to the one established within the autoclave, so that it is not necessary to provide gaskets having a high sealing effect at regions 16, 17 where the materials are brought in or pulled out from the apparatus.

In this way, the sealing action is focused at the nip areas between cylinder 5 and the pair of side cylinders 4 and 6. For that purpose, the three cylinders may have different shapes, while being all adapted to keep both felt 3 and fabric 11 in a compressed condition whereby the two materials, so compressed, build a sealing and a barrier against steam leakage outflows. In any case, the distance between the cylinders, and more particularly between the cylinder surfaces traversed by the felt and the fabric, is shorter than the total thickness of the two materials, whereby the latter must get compressed.

FIG. 2 shows the preferred embodiment wherein the pair of outer cylinders 4 and 6 have a smooth outer surface, with a uniform cross section, while center cylinder 5 is preferably recessed for a depth and length suitable to receive felt 3 and fabric 11 therein, while retaining two portions 12 of larger cross section at both ends. As an example, assuming that the felt is 180 cm wide and 5 mm thick, the recessed area will be wider than 180 cm, and shallower than 5 mm, whereby said felt may lie down perfectly breadthwise, while remaining slightly compressed in the thickness direction, for sealing purposes. It should be noted that the felt is itself compressible.

End regions 12 of cylinder 5 may be preferably lined with a rubber-like or resinous material, in order to improve sealing and to avoid steam leakages from the ends, where the "gasket" provided by the paired compressed materials is missing. It should be noted that this resilient lining may be advantageously applied to all the cylinders, including the side ones 4 and 6, in order to improve the sealing and increase felt compression.

Referring now to FIG. 3, there is shown therein a further embodiment of the introduction and withdrawing cylinders wherein the peripheral recess is provided on both outer cylinders 4 and 6, while inner cylinder 5 is smooth. Of course, the same remarks made previously referring to FIG. 2, concerning width and depth of the recess still hold in this case. An embodiment might also be provided wherein all the three cylinders are recessed, but in this case it should be borne in mind that the sum of the depths of the pair of matching recessed areas should be appropriate to retain the felt and the fabric under a pre-compressed condition, in that it is slightly less than the thickness of the cloths.

On the other hand, sometimes the felt, being subjected to the steam pressure and the mechanical strain imposed thereupon, has a tendency to shrink heightwise with time. When using recessed cylinders, in order to avoid that the play between the edge of the felt that has shrunk so far and the ends of the recessed area may become exaggerated whereby the sealing may be jeopardized, it will be preferable to use the approach shown in FIG. 4, with the three cylinders completely smooth, free of any recess. Felt 3 and fabric 11 are compressed against each other in that the mutual distance between cylinders will be adjusted to remain shorter than the thickness of the associated materials. In order to close the slit left between the felt edge and the side members 15 supporting the cylinders, where a steam leakage might take place, antifriction material pads 13, 13' are provided, typically made of teflon or the like. Therefore these pads, a total of four, provide sealing gaskets replacing the non-recess ends 12 of the cylinders, according to previous FIGS. 2 and 3, with the least possible friction. While felt 3 progressively shrinks in height, as mentioned above, said pads may be made to move forwards and inwards relative to the cylinders, by means of any known mechanism, inside or outside the autoclave. Threaded devices 14, 14' are shown in FIG. 4. In such a way, the slit left between the outer edges of back cloth 3 and side members 15 will always be perfectly sealed and steam leakages in that area will be prevented, at extremely low friction conditions.

Possible additions and/or modifications may be made by those skilled in this art to the embodiments described and shown above, of the device according to this invention, without exceeding the scope of this invention.

I claim:

1. A device for feeding fabrics into and withdrawing fabrics from an autoclave (1) for continuous decatizing around a foraminous rotating cylinder (2) having guide rollers (9, 10) located at a beginning and at an end of a path of the fabric around the cylinder (2), with the fabric (11) being associated with a back cloth comprised of a compressible felt (3) having a thickness, the device comprising a rotating center cylinder (5) and first and second side cylinders (4, 6) located adjacent to the center cylinder in an autoclave opening such that nips are located between the center cylinder and each of the first and second side cylinders, the center cylinder and the first and second side cylinders each being made of a non-compressible material and being mounted for rotary movement about a stationary axis, the first side cylinder being adapted to bring the fabric (11) and the associated felt (3) into the autoclave and the second side cylinder (6) being located on an opposite side of the center cylinder from the first side cylinder and being adapted to remove the decatized fabric (11') and the associated felt (3') from the autoclave, the center cylinder (5) being recessed in the area of the fabric and the felt, with the recess having a depth which is less than the thickness of the felt (3, 3'), and peripheral sealing gaskets (7, 8) which contact the first and second side cylinders (4, 6) respectively, the peripheral sealing gaskets comprising resilient sheets, each having a free end which is adapted to slide in contact with a surface of a respective one of the first and second side cylinders along the whole length thereof.

2. The device of claim 1, characterized in that the unrecessed end areas of the cylinder (5) are lined with a resilient material.

3. A device according to claim 3, wherein all the cylinders (4, 5, 6) are completely lined with a resilient material.

4. The device of claim 1, characterized in that the pair of side cylinders (4, 6) are recessed on the side surface thereof for a length equal at least to the maximum width of the paired materials (3, 11: 3', 11'), unrecessed end areas (12) of said cylinders (4, 6) being lined with a resilient material.

5. A device according to claim 4, wherein all the cylinders (4, 5, 6) are completely lined with a resilient material.

6. A device for feeding fabrics into and withdrawing fabrics from an autoclave (1) for continuous decatizing around a foraminous rotating cylinder (2) having guide rollers (9, 10) located at a beginning and at an end of a path of the fabric around the cylinder (2), with the fabric (11) being associated with a back cloth comprised of a compressible felt (3) having a thickness, the device comprising a rotating center cylinder (5) and first and second side cylinders (4, 6) located adjacent to the center cylinder in an autoclave opening such that nips are located between the center cylinder and each of the first and second side cylinders, the center cylinder and the first and second side cylinders each being made of a non-compressible material and being mounted for rotary movement about a stationary axis, the first side cylinder being adapted to bring the fabric (11) and the associated felt (3) into the autoclave and the second side cylinder (6) being located on an opposite side of the center cylinder from the first side cylinder and being adapted to remove the decatized fabric (11') and the associated felt (3') from the autoclave, all three cylinders (4, 5, 6) being substantially smooth and each cylinder having a constant cross section, the nips between the center cylinder (5) and the first and second side cylinders (4, 6) having an opening height which is less than the thickness of the felt (3, 3'), and peripheral sealing gaskets (7, 8) being located in a position to contact the first and second side cylinders (4, 6) respectively, the peripheral sealing gaskets comprising resilient sheets, each having a free end which is adapted to slide in contact with a surface of a respective one of the first and second side cylinders along the whole length thereof.

7. The device of claim 6, wherein two interspaces are located between the center cylinder and each side cylinder at a position above and below edges of the fabric and the felt, the device further including two pairs of antifriction material pads (13, 13') inserted within said interspaces and on either side thereof, for laterally sealing said interspaces.

8. The device of claim 7, further comprising forward moving means (14, 14') for moving said pads (13, 13') within said interspaces, and adapted to adjust a depth of penetration of said pads according to a width of the fabric and the felt.

9. A device according to claim 8, wherein all the cylinders (4, 5, 6) are completely lined with a resilient material.

10. A device according to claim 7, wherein all the cylinders (4, 5, 6) are completely lined with a resilient material.

* * * * *